United States Patent [19]

Malta

[11] 3,941,082

[45] Mar. 2, 1976

[54] HANDBELL

[76] Inventor: Jacob H. Malta, 207 Decatur St., Doylestown, Pa. 18901

[22] Filed: May 16, 1974

[21] Appl. No.: 470,467

[52] U.S. Cl. ..... 116/171; 116/149

[51] Int. Cl.[2] ..... G10K 1/06; G10K 1/36

[58] Field of Search ..... 116/171, 148, 149, 167, 116/155, 131; 73/323

[56] References Cited

UNITED STATES PATENTS

| | | | |
|---|---|---|---|
| 294,184 | 2/1884 | Barton | 116/171 |
| 2,821,953 | 2/1958 | Langbart et al. | 116/131 |
| 3,049,922 | 8/1962 | Schwaneke | 73/323 |
| 3,139,855 | 7/1964 | Kunz | 116/171 |
| 3,207,124 | 9/1965 | Malta | 116/171 |
| 3,253,574 | 5/1966 | Malta | 116/171 |

FOREIGN PATENTS OR APPLICATIONS

| | | | |
|---|---|---|---|
| 802,996 | 10/1958 | United Kingdom | 116/155 |

*Primary Examiner*—Richard C. Queisser
*Assistant Examiner*—Daniel M. Yasich
*Attorney, Agent, or Firm*—John T. Marvin

[57] ABSTRACT

A handbell including an improved clapper assembly that is adjustable with respect to the force required to cause it to swing into strike contact with the bell and is independently adjustable to vary the tonal quality of its strike, whereby a variety of affects, including raw and muted sounds, may be obtained from a given bell through manual adjustment of the clapper which is possible during the course of playing the bell. Additional improvements reside in the specific construction of the adjustments and the means for indexing the position of the bell handle with respect to the clapper assembly.

6 Claims, 7 Drawing Figures

HANDBELL

This invention relates to handbells and is particularly concerned with handbells that are manually adjustable with respect to the tonal qualities thereof.

Handbells have been in general use for many years and have always been carefully fabricated and tuned so that different bells will produce different notes of the musical scale. A chorus of players using a plurality of tuned bells may render any given tune which falls within the range of notes offered by the specific bells. Handbell choruses are increasing in popularity and the control of the tonal quality of handbells is becoming of greater importance as the sophistication of the effort increases. To date, some degree of tonal control has been offered but it has always required a tooled adjustment of the bell ringing mechanism. In the present invention, I have provided an improved handbell of simple design which includes a clapper assembly that is adjustable with respect to (1) the force required to strike the bell, and (2) the tonal qualities emitted by the bell after it is struck. This last adjustment is capable of manual modification during the actual use of the bell and may be likened to the pedals on a piano whereby all or portions of a musical selection may be offered in muted, semi-muted or raw tones at will. This advance in handbell design enlarges tremendously the affect of any chorus and makes the rendition of the several selections professional in character and more pleasing to the ear.

It is, therefore, one of the objects of my invention to provide a handbell with a clapper adjustment means for controlling the swinging movements of its associated clapper whereby the force required to cause the clapper to strike the bell may be varied through simple adjustment of a polyurethane snubber assembly for changing its position relative to the swinging clapper.

Another object of the invention is to provide an improved clapper assembly wherein the tonal affects created upon striking the bell may be varied at will by the manual rotation of the clapper with respect to its shaft so as to expose different, opposed striking portions for contact with the bell and wherein several opposed pairs of striking surfaces are provided, each with a different degree of hardness.

In carrying out the above object, it is a further object of the invention to provide spring actuated detent means cooperating with the clapper and its supporting shaft for detachably holding the two in any desired, predetermined position.

Another object of the invention is to provide means for maintaining the handle of the bell and its clapper assembly in aligned relation with one another as a unit regardless of their position relative to the associated handbell, whereby the usual bell tang may be eliminated.

A still further object of the invention is to provide an identifying means, or strip, for the handle of the handbell that is easily associated therewith and may be incorporated within the handle through the use of a clear plastic covering which encloses and protects the identifying strip.

Further objects and advantages will be apparent from the following description, reference being had to the accompanying drawings wherein preferred embodiments of the present invention are clearly shown.

Further objects and advantages of the present invention will be apparent, reference being had to the accompanying drawings and description wherein preferred forms are clearly shown and described.

Figure 1:
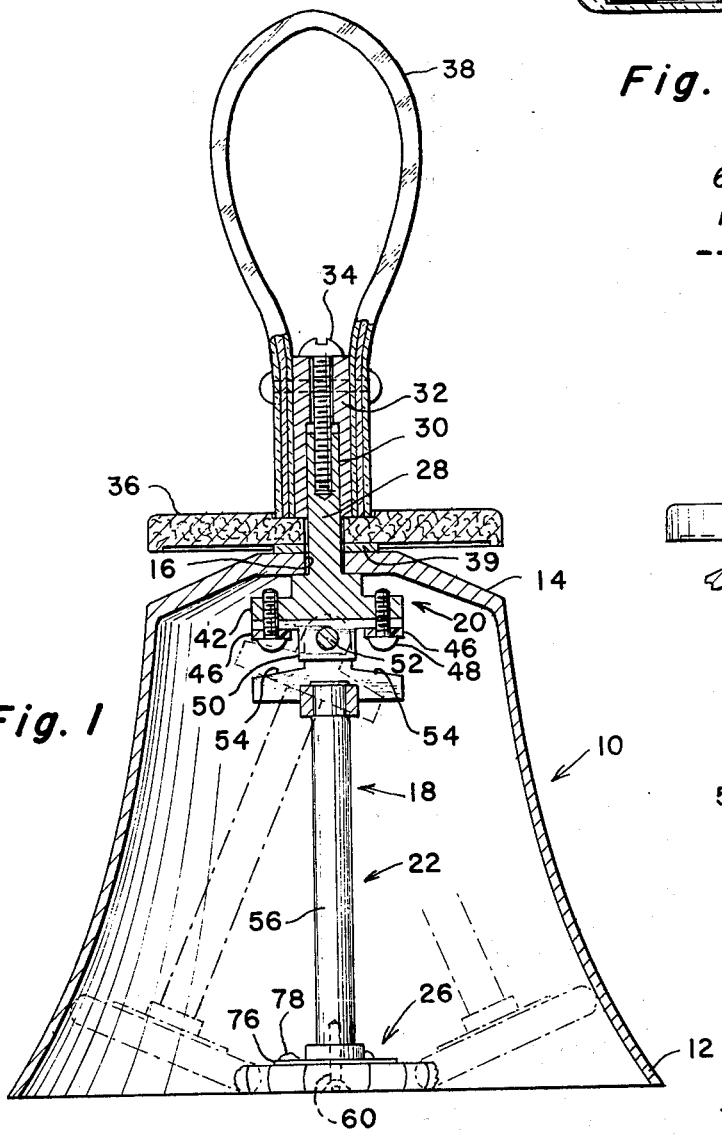
FIG. 1 shows a cross-sectional view of a preferred form of my invention.
Figure 6:
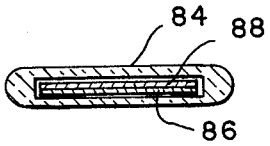
FIG. 6 is a view in section taken on line 6—6 of FIG. 2 and showing the construction of the handle and indicia strip.
Figure 2:
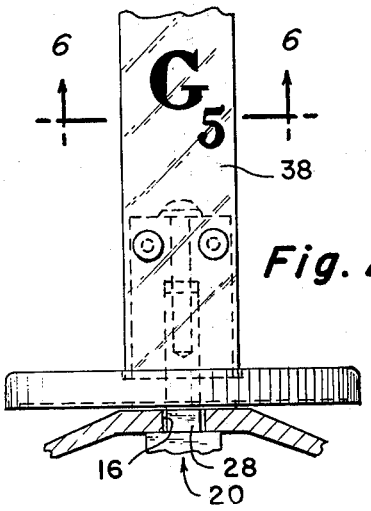
FIG. 2 is a view of the handle assembly only taken at 90° to the position shown in FIG. 1.

Referring to the drawings and with particular attention to FIG. 1, 10 is a cast and machined handbell having a generally flared, open end terminating in a circumferential lip 12, together with an opposed closed end 14 which includes a centrally located circular aperture 16 therethrough. It will be seen that the bell 10 does not have the usual tang surrounding this aperture which streamlines the structure and simplifies casting and subsequent machining procedures. Such a prior art construction is shown and described in my U.S. Pat. No. 3,207,124. The elimination of this tang has been made possible by the improved structure to be described hereinafter.

The bell 10 includes a clapper assembly 18 therein which comprises a support member 20, a clapper member 22 pivotally mounted thereon, and a clapper 26 depended from the member 22. The support member 20 extends outwardly in both directions from an upwardly extending square shaft 28 which passes through the aperture 16 in the bell 10. The aperture 16 is dimensioned so as to circumscribe the square shaft 28 for holding it in non-shifting relation with the centerline of the bell 10. The upper end of shaft 28 is slidably fitted in and guided by a longitudinally extending square cavity 30 in a handle base 32 and is held thereto by a screw 34. In this assembled relation, the handle base 32 and the depended clapper assembly 18 are integrated in non-rotatable relation to one another. Interposed between the closed end 14 of the bell and the handle base is a non-metallic hand shielding disc 36 provided to prevent accidental contact between the hand of the bell ringer and the bell. The handle base 32 is rectangular in cross section and a handle 38, to be described in more detail hereinafter, is riveted to the wider side of the handle base 32 or otherwise affixed. Thus, the handle 38 and its related clapper assembly 18 are indexed as to relative position ard are always held in predetermined, non-rotatable relation to one another. This condition is maintained even though the bell 10 may be rotated relative to the handle 38. This is a useful expedient since it permits periodic turning of the bell 10 relative to the handle to present new "strike" surfaces, whereby fatigue of the bell metal is lessened as is the possibility of indenting the bell surfaces at the strike areas, a condition often found in prior art bells where such relative movement is not possible. The addition of a metal washer 39 interposed between the shielding disc 36 and the bell 10 will facilitate turning of the bell relative to its handle 38. Otherwise, it may be necessary to loosen the screw 34 to accomplish this adjustment.

Rotation of the bell 10 relative to the handle and clapper has another distinct advantage. In all bell castings, certain portions thereof have different "wow" or "beat" surfaces as is well known in the art. These surface portions often change in character due to relaxation of the stresses through normalization of the cast metal due to aging. Under these conditions, it is often desirable to rotate the bell relative to the clapper in order to lessen these undesirable affects which is easily accomplished with the present design.

Figure 5:
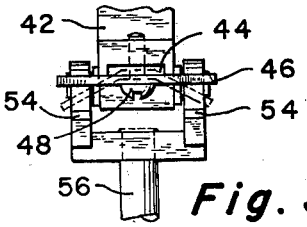
FIG. 5 is a view of the clapper shaft adjustment and pivot assembly taken at 90° to the position shown in FIG. 1.

The outward extension of the support member 20 comprises a horizontally positioned portion 42 having a rectangularly shaped groove 44 extending the entire length of its downwardly facing surface, as shown clearly in FIG. 5. A pair of resilient strips 46 are carried at opposite ends of the portion 42 each bridging the groove 44. The strips 46 are held in position by screws 48 which are threaded into the portion 42. Strips 46 are formed preferably from elastomeric type polyurethane material (such as "Cyanaprene," manufactured by American Cyanamid) having a durometer reading in the order of 60 to 70 Shore D so as to be sufficiently bendable to permit flexing for adjustment purposes as noted hereinafter. Of course variations are permissible according to the specific requirements. Polyurethane is particularly useful since it is tough, fatigue resistant and wears extremely well. The exact position of the strips 46 and their relation to the portion 42 of the support member 20 is clearly depicted in FIGS. 1 and 5. The strips 46 are individually adjustable through manipulation of the screws 48, which upon tightening, draws the center portions thereof into the groove 44 whereby the free ends of the strips 46 are bent downwardly as shown in dotted lines in FIG. 5.

The support member 20 also includes a mounting portion 50 which is assembled with and fixedly positioned adjacent the center of the member 20. Of course, it may be an integral part of member 20 if desired. In either instance, the portion 50 is cross drilled adjacent its center to provide a journal for pin 52. The pin 52 pivotally carries the clapper member 22. The upper end of the clapper member 22 comprises two pairs of opposed sloping surfaces 54 wherein each pair of surfaces is positioned so as to limit the swinging movement of the member 22 by engagement with the outer ends of the limiting strips 46. This interference and engagement will be clearly seen by referring to FIG. 5. Thus, as the strips 46 are adjusted through tightening of screws 48, the free ends thereof bend downwardly for increasingly, resiliently restraining the swinging movement of the member 22. The more the strips are bent, the greater the restraint and vice versa. In this manner, the effort required to cause the clapper 26 to strike the bell may be varied in either or both directions through selective and/or differential manipulation of the adjustment screws 48.

Figure 4:
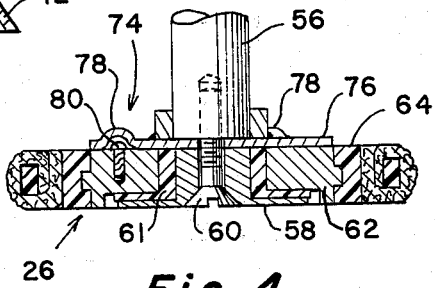
FIG. 4 is a view in section taken on line 4—4 of FIG. 3 and shows the detailed construction of one form of the adjustable clapper.
Figure 3:
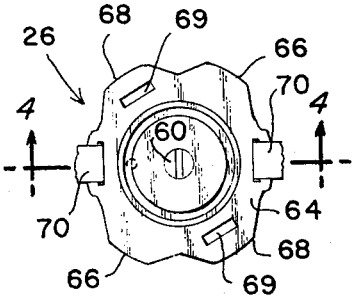
FIG. 3 is a plan view of one form of clapper with arrows indicating three striking positions each of which will create a different tonal affect.

The clapper 26 is carried on the free end of the clapper member 22 and is attached to a rod 56 which forms a part of the clapper member 22. The specific design of this clapper forms an important part of my invention. Referring to FIG. 4, one form of clapper 26 is shown wherein a central hub 58 is attached to the free end of rod 56 by means of a screw 60. The clapper 26 comprises a grouping of bonded together concentric parts with an elastomeric bushing 61 being interposed between the hub 58 and a second metallic ring 62. This in turn carries and supports an outer ring 64 shown in plan view in FIG. 3. The ring 64 may be fabricated from a relatively hard molded polyolefin type elastomer such as polyethylene or polypropylene (one such material, manufactured by Eastman Plastics, is known by the trade name TENITE) with a durometer reading in the order of 75–85 Rockwell R, which provides a striking surface 66 therearound. The striking surface of the ring 64 may offer different hardness strike surfaces 68 therearound for varying the tone. This is accomplished by drilling or molding relief portions 69 adjacent the surfaces. A third opposed pair of striking surfaces may also be provided wherein felt or some other relatively soft material is applied to opposed striking surfaces of the clapper 26. In this embodiment, the clapper will offer three opposed areas of strike, each with a different impact effect and available according to its position relative to the plane of swing of the clapper 26. Of course, more or less areas of differing impact effect may be made available and this is a matter of choice tempered by the diameter of the clapper 26.

In order to make these varying hardness portions available, I have provided an adjustable detent device 74 built into the clapper 26. This includes a spring metal disc or plate 76, non-rotatable with respect to the rod 56, with a plurality of spaced indentations 78 therearound. These are positioned so as to correspond with the areas of varying hardness of the clapper surface. A button or detent 80 is carried by the ring 62 is positioned so as to be resiliently held within any one of the depressions 78 in the disc 76 according to its position. In this manner, the clapper 26 may be grasped by a player during the rendition of a tune, turned relative to the rod 56 and against the resistance of the detent 74 to a second or third position with a minimum of time being consumed. When this is accomplished, the bell will have a different tonal quality according to the position selected for the clapper. In this connection, all strike surfaces around the clapper 26 fall within a circle with the clapper shaft 56 as a center, whereby the distance required to cause a strike upon the bell 10 is always the same.

Figure 7:
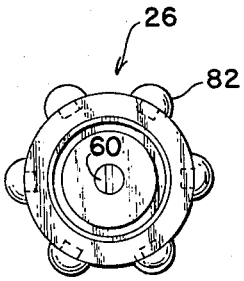
FIG. 7 is a plan view of another form of adjustable clapper showing a plurality of opposed pairs of striking buttons.

Another form of clapper is depicted in FIG. 7. It has all of the advantages of the one shown in FIG. 3 but varies in design, flexibility and simplicity. This embodiment includes the central hub and the same adjustment means but differs so far as the striking surfaces are concerned. Here, a plurality of applied surface buttons 82 and used spaced around the outer periphery of the clapper. Opposed pairs of buttons 82 are of the same hardness and each opposed pair is of different hardness to accomplish the same results as described in connection with the clapper shown in FIG. 3. It is apparent that other deviations may also be used without departing from the spirit of my invention which comprehends a manually adjustable clapper having a plurality of strike portions, in opposed relation and of different hardness, to selectively produce a variety of tonal effects.

Returning to the handle 38, and as mentioned heretofore, I prefer to make this of an extruded, flat tube 84 of plastic material, such as clear vinyl like VYRAM as manufactured by Monsanto. An indicia strip 86 with indicia printed or stencilled thereon may be slipped within this tube and will be clearly visible therethrough.

The assembly may then be bent to form and riveted or otherwise affixed to the handle base 32. If desired, a metal backing strip 88 may be incorporated to back the indicia strip 86 which in this instance may be paper, etc. Either embodiment has proved to be fully satisfactory.

The handbell disclosed herein is a distinct advance in the art. The device offers adjustability not found heretofore and this flexibility in use enlarges the capabilities and life of the bell. Further, because of the manually adjustable features incorporated within the clapper, the bell is enlarged in its range of use over those of the prior art.

While the forms of embodiment of the present invention as herein disclosed, constitute preferred forms, it is to be understood that other forms might be adopted, all coming within the scope of the claims which follow.

I claim:

1. A handbell comprising in combination: a bell having a generally closed end; a clapper assembly removably carried within said bell centrally of the closed end thereof, said clapper assembly comprising a transversely extending, fixedly mounted pivot block; a clapper shaft having one end pivotally associated centrally of said block and including opposed surfaces sloping downwardly and away from said central pivot point, said shaft being adapted for pivotal swinging movements in one plane only with respect to said pivot block; individually adjustable, non-metallic limiting means each consisting of a generally flexible strip of resilient, polyurethane material carried by and positioned adjacent opposite ends of said pivot block, the ends of said strip positioned by said means for selectively engaging said sloping surfaces for yieldably opposing extreme pivotal, swinging movement of said clapper shaft in either direction thereof; and a clapper member carried by the free end of said clapper shaft and adapted to strike said bell during said extreme pivotal, swinging movements of said clapper shaft as adjustably opposed by said engagement with said limiting means.

2. A handbell comprising in combination: a bell having a generally closed end; a clapper assembly adapted to be removably carried within said bell and located centrally of the closed end thereof, said clapper assembly comprising a clapper shaft having one end pivotally associated centrally of the closed end of said bell and carrying a clapper member at its free extremity, said clapper member comprising a generally circular striker assembly positioned substantially normal to said clapper shaft and including at least three opposed pairs of surface portions wherein each of said pairs has a different degree of hardness and wherein said assembly is rotatable relative to said clapper shaft for selectively positioning desired surface portions in striking relation to said bell; detent means for said striker assembly; and indexing means on said handle and said clapper assembly cooperating with said detent means for releasably maintaining said striker assembly in any pre-selected position relative to said clapper shaft.

3. A handbell comprising in combination: a bell having a generally closed end; a clapper assembly adapted to be removably carried within said bell and centrally of the closed end thereof, said assembly comprising a clapper shaft having one end pivotally associated centrally of the closed end of said bell and carrying a clapper member at its free extremity, said clapper member comprising a generally circular striker assembly rotatably positioned substantially normal to said clapper shaft and including a plurality of striking buttons positioned in opposed pairs around the outer periphery thereof and wherein each pair of buttons has a different degree of hardness; means on said clapper assembly coacting with said rotatable striker assembly for permitting rotation of said striker assembly relative to said clapper shaft for selectively positioning desired pairs of buttons in striking relation to said bell; and detent means cooperating with said rotatable striker for releasably holding said striker assembly in any preselected position.

4. A handbell, comprising in combination: a bell having a generally closed end and including a centrally located aperture therethrough; a clapper assembly swingable in one plane only and adapted to be positioned within said bell; a generally strap-like directional handle external of said bell including a base portion connected with said clapper assembly through said aperture; means on said handle and said clapper assembly for positively indexing said handle in non-rotative position with respect to said clapper assembly so that the strap-like handle visually indicates the direction of swing of said clapper assembly; and clamping means associated with said handle and said clapper assembly for maintaining the two in substantially non-rotative relation with respect to said bell, whereby said handle and said clapper assembly may be rotated as a unit with respect to said bell, when desired, through disablement of said clamping means while maintaining the non-rotative relation between the handle and the clapper assembly.

5. The handbell claimed in claim 4 wherein the handle includes a rectilinear longitudinally extending cavity adjacent its base and said clapper assembly includes a mating, rectilinear, longitudinally extending stud that fits slidably within said cavity and in non-rotative relation thereto; and means for locking said handle to said clapper assembly and simultaneously clamping said bell therebetween.

6. The handbell claimed in claim 4 wherein said handle includes a square longitudinally extending cavity adjacent its base and said clapper assembly includes a mating, square, longitudinally extending stud that fits slidably within said cavity and in non-rotative relation thereto; and means for locking said handle to said clapper assembly and simultaneously clamping said bell therebetween.

* * * * *